United States Patent [19]

Plenter

[11] Patent Number: 4,708,531

[45] Date of Patent: Nov. 24, 1987

[54] PIVOT CONNECTIONS FOR USE WITH MINE ROOF SUPPORTS

[75] Inventor: Dieter Plenter, Recklinghausen, Fed. Rep. of Germany

[73] Assignee: Gewerkschaft Eisenhutte Westfalia GmbH, Lunen, Fed. Rep. of Germany

[21] Appl. No.: 920,962

[22] Filed: Oct. 20, 1986

[30] Foreign Application Priority Data

Nov. 9, 1985 [DE] Fed. Rep. of Germany ..... 3539800

[51] Int. Cl.[4] ..... E21D 23/04

[52] U.S. Cl. ..... 405/296; 405/291; 403/348; 403/353

[58] Field of Search ..... 405/295, 296; 403/349, 403/353, 348, 315, 316, 317, 319; 285/82, 91; 24/590, 591, 593, 594

[56] References Cited

U.S. PATENT DOCUMENTS

| | | | |
|---|---|---|---|
| 2,165,163 | 7/1939 | Waters | 285/91 |
| 2,744,771 | 5/1956 | Laurent | 285/91 |
| 3,017,217 | 1/1962 | Keating | 403/353 |
| 3,860,209 | 1/1975 | Strecker | 403/348 |
| 4,125,339 | 11/1978 | Pittinger, Sr. et al. | 403/353 |
| 4,197,762 | 4/1980 | Yamana | 403/348 |
| 4,236,850 | 12/1980 | Koppers et al. | 405/291 |
| 4,293,247 | 10/1981 | Rosenberg et al. | 405/296 |
| 4,392,279 | 7/1983 | Schwager | 24/593 |
| 4,400,856 | 8/1983 | Tseng | 24/590 |
| 4,552,487 | 11/1985 | Weirich | 405/295 |

*Primary Examiner*—Dennis L. Taylor

*Attorney, Agent, or Firm*—Samuels, Gauthier, Stevens & Kehoe

[57] ABSTRACT

A mine roof support has gap seals in the form of L-shaped plates on its roof cap and goaf shield. The side walls of the plates overlap at the junctures between the roof cap and the goaf shield and these walls are interconnected with pivot connections each of which is composed of complementary components fitted into openings in the walls. The components combine to form a pivot journal and and are locked to one another by a twist catch which can be released by relative rotation of the components.

16 Claims, 4 Drawing Figures

PIVOT CONNECTIONS FOR USE WITH MINE ROOF SUPPORTS

FIELD OF THE INVENTION

The present invention relates in general to mine roof supports of the type comprising a roof cap supported on a floor sill with the aid of hydraulic props and a goaf shield pivotably connected to the roof cap and floor sill.

BACKGROUND TO THE INVENTION

In a roof support of the aforementioned kind, it is known to provide gap seals in the form of L-shaped plates on the roof cap and goaf shield. These plates are usually flexibly adjustable laterally of the support so that the side walls thereof engage side walls of similar plates on adjacent roof supports to seal off the gaps between the caps and goaf shields to provide a screen between the working or access zone and the stowage or rubble zone of the mine working. German Patent Specification No P28 53 050 describes such an arrangement. In the region where the goaf shield of the support meets the roof cap the side walls of the gap sealing plates overlap one another and it is known to interconnect the overlapping walls with pivot joints to permit the gap sealing plates to follow pivotable movements between the shield and the roof cap. Hitherto these pivot joints have been detachably secured in position with the aid of locking plates fixed in position with screws. The accessibility of the screws is poor and the screws are prone to become jammed with rust, especially in the harsh environment in a typical mine working.

A general object of the present invention is to provide an improved pivot connection for the overlapping side walls of the gap seal of a roof support.

SUMMARY OF THE INVENTION

A pivot or hinge connection constructed in accordance with the invention is composed of a pair of complementary unitary components which inter-engage within openings or apertures in the side walls as a twist catch released or made by relative rotation of the components. The components thus provide a releasable pivot journal.

A connection constructed in accordance with the invention is notably simple yet robust, is not particularly susceptible to soiling and corrosion and can be dismantled and assembled in situ without difficulty by relative rotation.

The components of the connection may be of plate-like form: one with an annular flange which seats within a recess of a bearing ring lining one of the apertures and the other with a plate which abuts the side wall opposite the bearing ring. The one component may have at least one undercut or recessed portion forming a pocket with the flange into which a radial wing-like projection of the other component can be moved to lock the components together in the manner of a bayonet connection. Preferably, two such portions and projections are provided. The recessed portions may be of segmental shape with arcuate outer surfaces each extending over about 90° which combine to provide a journal surface for the apertures and arcuate inner surfaces receiving a cylindrical region of the other component which axially separates the wings or projections from the plate thereof. The portions which have an L-shaped cross-section with axial and radial regions are spaced apart by gaps larger than the wings of the other component which can reliably receive the latter.

Bores in the flange of the one component may locate a tool used to effect part rotation of the components to make or break the twist catch.

It is advisable to inhibit relative rotation of the components when locked together to avoid inadvertent release of the catch. To achieve this, the components can be additionally secured by a bolt or screw although a preferred arrangement has a clamping pin or sleeve driven into bores of the components which are aligned when the catch is made. In addition, stop means on the side wall which abuts the plate of the other component can engage with a flat side edge of this plate and prevent rotation of the other component in one direction. This can complement the rotation of the one component in making and breaking the catch.

The invention may be understood more readily, and various other features and aspects of the invention may become apparent, from consideration of the following description.

BRIEF DESCRIPTION OF DRAWINGS

An embodiment of the invention will now be described by way of example only, with reference to the accompanying drawings, wherein.

DESCRIPTION OF PREFERRED EMBODIMENT

Figure 1:
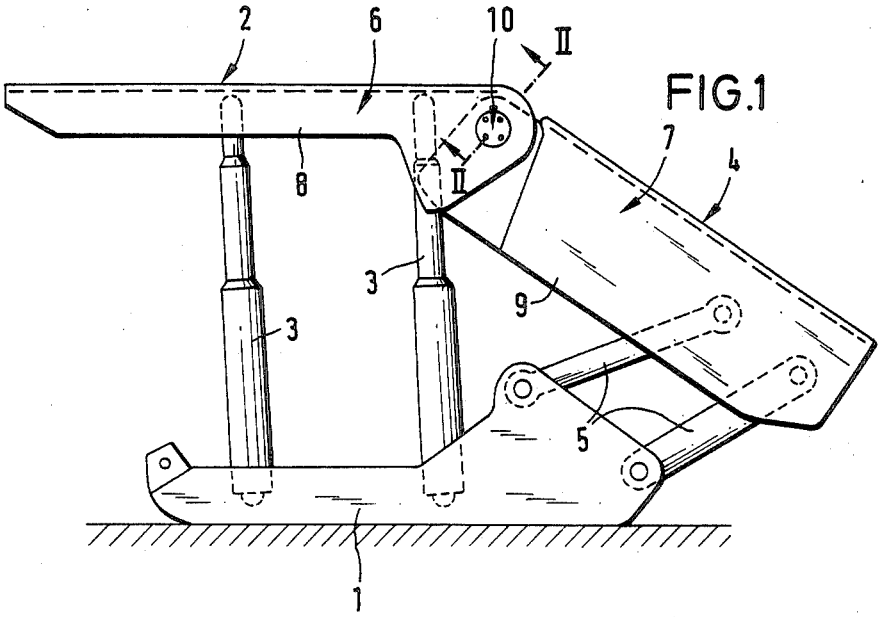
FIG. 1 is a schematic side view of a roof support constructed in accordance with the invention.

As shown in FIG. 1 and in known manner, a roof support is composed of a floor-engaging structure 1, a roof-engaging structure or cap 2 and hydraulic props 3 connected in articulated manner between the respective structures 1, 2. The floor-engaging structure 1 can take the form of a one-piece or multi-part skid. A goaf shield 4 is pivotably connected to the rear of the roof engaging structure 2 and a system of guide levers 5 which form a lemniscate linkage connects the shield 4 to the floor engaging structure 1. The roof engaging structure 2 and the goaf shield are provided with gap seals in the form of L-shaped plates 5, 7. One top section or wall of each plate 6, 7 extends laterally of the shield 4 or roof cap 2 while the other side section or wall projects from the top wall towards the floor of the working. As is known, the plates 6, 7 are adjustable laterally of the support, i.e. perpendicular to FIG. 1 and are rendered resiliently flexible laterally of the support to engage with their side walls the side walls of adjacent roof supports to screen off the goaf or stowage zone from the working zone of the mine working. Springs and/or hydraulic rams can adjust the sealing plates 6, 7 in the manner described in German Patent Specification No P28 53 050.

In the end regions of the juncture between the roof cap 2 and the goaf shield 4 the side walls 8, 9 of the sealing plates 6, 7 overlap with the side walls 8 of the seals 6 for the roof cap 2 outside the side walls 9 of the seals 7 for the goaf shield 4. In these overlapping regions pivot joints or connections 10 are provided between the overlapping side walls 8, 9 to allow the side walls 8, 9 to be laterally displaced together for adjustment but to follow any pivotal movement between the roof cap 2 and the goaf shield 4.

Figure 2:
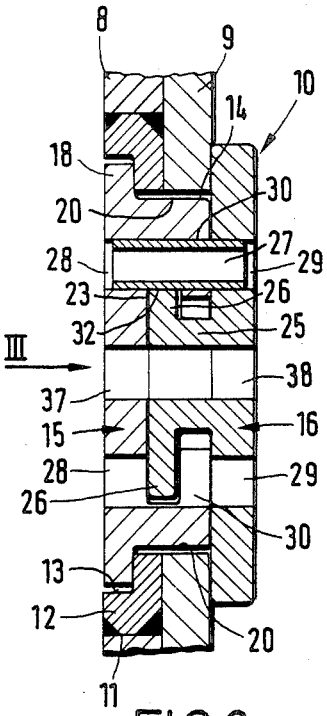
FIG. 2 is a sectional view of part of the support showing a pivot connection thereof, the view being taken along the line II—II of FIG. 1 and on a somewhat larger scale than that of FIG. 1.
Figure 3:
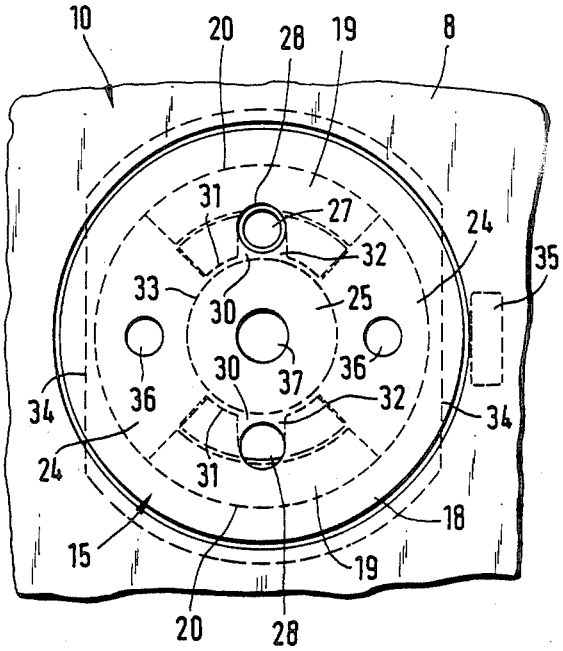
FIG. 3 is a side view of the part of the support shown in FIG. 2, the view being taken in the direction of arrow III of FIG. 2.
Figure 4:
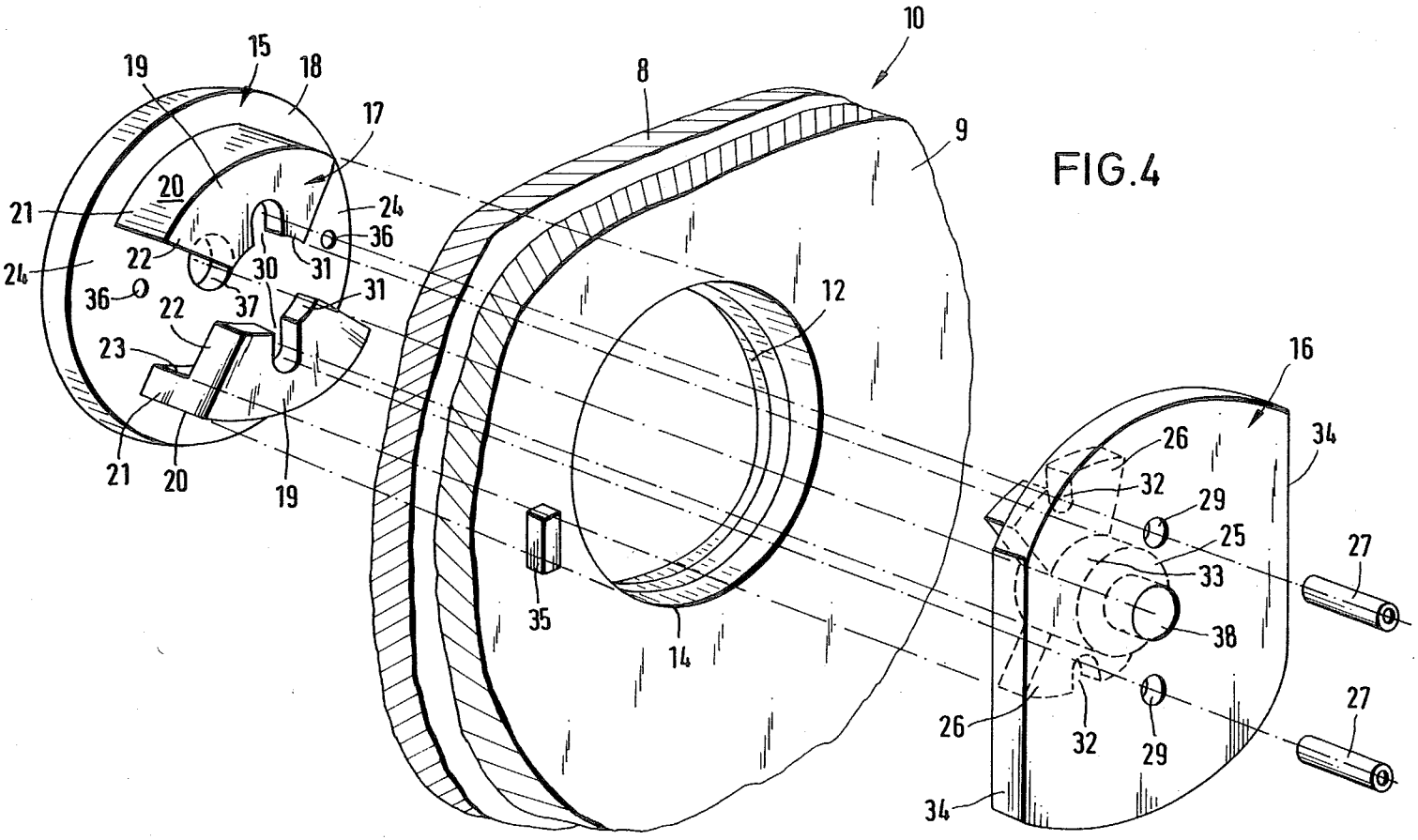
FIG. 4 is an exploded perspective view of the part of the support represented in FIGS. 2 and 3.

FIGS. 2 to 4 depict one of the pivot connections 10 in detail. As shown, the outer side wall 8 has a circular opening 11 into which a bearing ring 12 is welded. The ring 12 has a recess 13. The inner side wall 9 has an aperture 14 aligned with the inner periphery of the ring 12. Components 15, 16 engage within the apertures to define the pivot joint between the walls 8, 9. The component 15 has an annular flange 18 which locates in the recess 13 of the bearing ring 12. The outer side face of this flange 18 lies flush with the outer side surfaces of the bearing ring 12 and the side wall 8 when the component 15 is fitted. The component 15 also has two shaped pocket-forming portions 19 in diametrically opposed positions projecting from the flange 18. These portions 19 have curved outer peripheral surfaces 20 which locate within the ring 12 and the aperture 14 and thereby form a pivot journal surface. The surfaces 20 each extend through an arc of about 90°. The portions 19 also have curved inner peripheral surfaces 31.

Each portion 19 has an L-shaped cross-section with an axial region 21 adjoining the flange 18 and a radial region 22 spaced from the flange 18 to define a pocket or opening 23 therebetween. The outer faces of the regions 22 lie flush with the outer side face of the side wall 9 when the component 15 is fitted. The side edge faces of the portions 19 define segmental spaces 24 each of which extends over an arc of about 90°.

The component 16 serves to lock the component 15 in place. The component 16 has a stout plate portion which abuts the outer face of the side wall 9 and a portion which extends axially towards the flange 18 of the component 15. The plate portion has flat edge surfaces 34. The axial portion takes the form of a cylindrical boss 25 with a peripheral outer surface 33 adjoining the plate portion. A pair of radially projecting wings 26 adjoin the boss 25 at diametrically opposed locations. The wings 26 are again of segmental form each with an outer peripheral surface with an arc somewhat less than 90° so as to be easily received within the spaces 24. The peripheral surface 33 of the boss 25 fits within the inner peripheral surfaces 31 of the portions 19 when the components 15, 16 are brought together. The wings 26 and the portions 19 then co-operate as a twist catch or bayonet fitting which serve to lock the components 15, 16 together. During assembly, the component 15 is placed with its flange 18 in the recess 13 of the bearing ring 12 and the component 16 is introduced into the aperture 14 and orientated to bring the wings 26 into the spaces 24. A stop member 35 provided on the wall 9 serves to engage with one or other surface 34 of the plate portion of the component to prevent the component 16 rotating relative to the wall 9. The component 15 is then partially rotated relative the component 16 about the axis of the connection 10 to bring the wings 26 into the pockets 23 behind the radial wall regions 22 of the portions 19. This locks the components 15, 16 together and establishes the connection. It is desirable to prevent relative counter-rotation of the components 15, 16 and inadvertent release of the components 15, 16 after the twist catch has been made. For this purpose, the components 15, 16 have bores 28, 29 which can be aligned when the wings 26 are set in the pockets 23. The bores 28 extend through the flange 18 and the axial regions 21 of the portions 19. Slots 30 in the radial regions 22 are open to the inner peripheral surfaces 31 of the portions 19 and aligned with the bores 28. Similarly the bores 29 extend through the plate portion of the component 16 and slots 32 provided in the wings 26 are open to the outer peripheral surfaces of the wings 26 and align with the bores 29. With the respective bores 28, 29 and slots 30, 32 aligned one or more pins or sleeves 27 can be inserted to restrain partial rotation of the components 15, 16.

Although during assembly, the component 15 can be partially rotated by hand to lock with the wings 26 of the component 16 a suitable tool can be located by additional holes 36 in the flange 18 and used to effect this operation. The flange 18 is also provided with a central bore 37 and the plate portion and boss 25 of the component 16 are provided with a central bore 38 which aligns with the bore 37 when the components 15, 16 are assembled. These bores 37, 38 can facilitate dismantling of the connection 10 with another tool. If desired a screw or nut and bolt can be received within the bores 37, 38 to clamp the components 15, 16 together.

The invention is not limited to the embodiment described above and various modifications can be made without departing from the scope of the invention.

I claim:

1. In a mine roof support comprising a roof-engaging structure, a floor-engaging structure, one or more hydraulic props disposed between the roof and floor engaging structures, a goaf shield, means pivotably interconnecting the goaf shield to the roof and floorengaging structures, gap seals in the form of L-shaped plates displaceably mounted on the goaf shield and the roof-engaging structures, the plates having side walls which overlap in the regions where the goaf shield and the roof-engaging structure are interconnected and a pivot connection between the overlapping side walls of the plates; the improvement comprising the pivot connection is composed of aligned apertures in the side walls, and a pair of complementary components engageable within the apertures from opposite sides, the components being provided with means defining a twist catch effected by relative rotation of the components to detachably lock the components together.

2. A support according to claim 1, wherein one of the components has projections providing pivot surfaces journalled in said aligned apertures and pockets and the other of the components has projections which engage in the pockets in the manner of a bayonet connection and provide the twist catch.

3. A support according to claim 2, wherein the projections of the first component are of segmental shape and also have an L-shaped cross-section with portions extending axially and radially of the apertures and the projections of the other component are of segmental shape.

4. A support according to claim 3, wherein the projections of the first component have spaces therebetween which are larger than the projections of the other component.

5. A support according to claim 1, wherein one of the apertures is lined with a recessed bearing ring and one of the components has a flange which fits in the recess of the ring and lies substantially flush with the outer face of the side wall containing said one aperture.

6. A support assembly according to claim 5, wherein the other component has a plate portion which abuts the outer face of the other side wall and a cylindrical axial part which projects into the aperture in said other side wall and joins with at least one radial projection constituting part of the twist catch defining means.

7. A support assembly according to claim 3, wherein the projections of the first component have arcuate inner and outer peripheral surfaces, and the outer surfaces provide the pivot journal surfaces.

8. A support according to claim 7, wherein the other component has a plate portion which abuts the outer face of the other side wall and a cylindrical axial part which joins with the projections and the plate portion and wherein the cylindrical part fits within the inner peripheral surfaces of the projections of the first component.

9. A support according to claim 7, wherein the outer peripheral surface of each projection of the first component extend through an arcuate angle of around 90°.

10. A support according to claim 1 and further comprising means for detachably locking the components together.

11. A support according to claim 3, wherein bores are provided in the components which align when the twist catch is made and a locking element is inserted into the aligned bores to prevent relative rotation of the components.

12. A support according to claim 11, wherein the bores communicate with slots in the projections of the components which facilitate the fitting of the locking element.

13. A support according to claim 1, wherein the components have central through bores coaxial with the apertures.

14. A support according to claim 1, wherein at least one of the components has holes therein for location with a tool used to rotate the component partially to effect connection or disconnection of the twist catch.

15. A support according to claim 6, wherein the plate portion of the other component has at least one flat side edge which engages with stop means to inhibit rotation of the other component.

16. A support according to claim 5, wherein said one component has a shaped portion adjoining the flange and providing a pocket for receiving a projection of the other component, the pocket and projection constituting at least in part the twist catch defining means.

* * * * *